US010881186B2

(12) United States Patent
Steele

(10) Patent No.: US 10,881,186 B2
(45) Date of Patent: Jan. 5, 2021

(54) COUPLED CYLINDRICAL MAKEUP STORAGE APPARATUS

(71) Applicant: Valerie Steele, New York, NY (US)

(72) Inventor: Valerie Steele, New York, NY (US)

( * ) Notice: Subject to any disclaimer, the term of this patent is extended or adjusted under 35 U.S.C. 154(b) by 179 days.

(21) Appl. No.: 15/873,898

(22) Filed: Jan. 18, 2018

(65) Prior Publication Data

US 2018/0199690 A1 Jul. 19, 2018

Related U.S. Application Data

(60) Provisional application No. 62/448,012, filed on Jan. 19, 2017.

(51) Int. Cl.

| | |
|---|---|
| ***A45D 40/24*** | (2006.01) |
| ***A45D 33/18*** | (2006.01) |
| ***A45D 33/28*** | (2006.01) |
| ***B25H 3/02*** | (2006.01) |
| ***A45D 33/20*** | (2006.01) |
| ***A45D 33/00*** | (2006.01) |
| *A45D 40/00* | (2006.01) |
| *A45C 5/00* | (2006.01) |
| *A45D 34/00* | (2006.01) |
| *A45C 11/34* | (2006.01) |
| *A45D 40/18* | (2006.01) |
| *A45C 11/16* | (2006.01) |
| *A45D 34/06* | (2006.01) |

(52) U.S. Cl.

CPC ..... *A45D 40/24* (2013.01); *A45D 33/006* (2013.01); *A45D 33/18* (2013.01); *A45D 33/20* (2013.01); *A45D 33/28* (2013.01); *B25H 3/025* (2013.01); *A45C 5/005* (2013.01); *A45C 11/16* (2013.01); *A45C 11/34* (2013.01); *A45D 34/06* (2013.01); *A45D 40/18* (2013.01); *A45D 2034/007* (2013.01); *A45D 2040/0012* (2013.01); *A45D 2200/05* (2013.01); *A45D 2200/25* (2013.01)

(58) Field of Classification Search

CPC ..... A45D 33/006; A45D 33/18; A45D 33/20; A45D 33/28; A45D 34/06; A45D 40/18; A45D 40/24; A45D 2034/007; A45D 2040/0012; B25H 3/025

See application file for complete search history.

(56) References Cited

U.S. PATENT DOCUMENTS

| | | | | | |
|---|---|---|---|---|---|
| 3,188,157 | A * | 6/1965 | Rand | A47B 87/0292 | 312/202 |
| D267,153 | S * | 12/1982 | Lebowitz | D19/75 | |
| D280,739 | S * | 9/1985 | Wang | D19/77 | |
| 4,560,078 | A * | 12/1985 | Dubuisson | A45D 33/00 | 206/503 |
| 4,815,483 | A * | 3/1989 | DuGrenier | A45D 33/00 | 132/295 |
| 6,041,935 | A * | 3/2000 | Yang | A45C 11/00 | 206/509 |
| 6,145,515 | A * | 11/2000 | Wu | A45D 33/00 | 132/294 |
| 2009/0272659 | A1* | 11/2009 | Kaiser | A45D 33/20 | 206/235 |

* cited by examiner

*Primary Examiner* — Ryan A Reis

(57) ABSTRACT

A storage apparatus featuring a first tower for storing makeup in storage shelves, with the storage shelves configured to rotate around a second tower featuring a cavity for storing makeup tools and an elevator platform to facilitate access to those makeup tools.

18 Claims, 10 Drawing Sheets

COUPLED CYLINDRICAL MAKEUP STORAGE APPARATUS

PRIORITY CLAIM

This application claims priority to U.S. Provisional Application Ser. No. 62/448,012, filed Jan. 19, 2017. The above referenced application is incorporated herein by reference as if restated in full.

BACKGROUND

The application of makeup is a morning ritual in which many people, particularly females but also males, partake in every day of their lives. The art has been with civilization since the earliest days, and occurs across cultures, classes, and any and all divisions of humankind. There is a thriving industry to provide the makeup, which exists in liquid and powder form, and the tools, including brushes of all sorts. Makeup is applied by both professionals and amateurs, for the purpose of business as well as pleasure. As an aesthetic tradition, makeup has many schools of thought with regard to what makeup should do and how it should be used. A makeup artist has to take into account the purpose of the application, the look desired by the recipient, and the natural skin tones, skin quality, and hair color of the recipient in order to match, contrast, emphasize, or conceal.

However, while there is an abundance of makeup colors and forms, makeup tools, schools of thought, and styles, the organizational options are lacking. Organizational tools are generally fitted to a single makeup kit but not designed to conveniently provide access to makeup tools and colors from other kits. Also, they are generally configured to be held in the hand and frequently have stability issues. When organization tools are designed to store a larger set of makeup items, they do not provide easy access to all the items at any given time. This application describes an apparatus that provides both easy access and organization.

SUMMARY

The present disclosure describes, generally, a makeup storage and access apparatus featuring a plurality of rotating shelves housed in a tower. However, the apparatus can also be used to store and access paints, pastes, capsules, tablets, powders, jewelry, food items, screws, bolts, washers, fasteners, or any other feasible category of pieces or components.

The tower may be of any suitable height, from 30 mm or less up to 600 mm or more. The tower may refer to a single or double extension in a vertical dimension, and as such may comprise a first and second tower. It is conceivable that the tower may also feature a triple extension.

An axis of rotation may traverse a spine of the tower, permitting the shelves to rotate around the axis. The axis of rotation may be adjacent to the first tower or concentric with the second tower. The spine may also be referred to hereafter as the second tower, and consequently the second tower may be adjacent to, concentric with, or located between the center and circumference/periphery of the first tower.

A series of shelves and shelf frames may comprise a first tower. The second tower may operate as a spine for the first tower, and may be concentric, overlapping, or adjacent to the first tower. The second tower may also feature a brush receptacle tranverse throughout a vertical portion. Brushes or other oblong devices may be placed within the brush receptacle.

The second tower diameter may range from 1 mm to 300 mm and the first tower diameter may range from 20 mm to 100 mm. The measurements of the first tower and the second tower may be selected so that one or more of the shelves may rotate around the axis of rotation without completely blocking, from an above-perspective, sight of and access to each shelf. The shelves may be of any geometric shape, including square, rectangular, ovalar, or circular. In a preferred embodiment, the shelves are circular. If the first or second towers are not cylindrical, then the measurements indicated may express width.

Each shelf may feature a rotation band that permits the shelf to rotate around the axis of rotation. The rotation band may be fitted to an exterior of the second tower so that the shelf rotates out and around the axis of rotation. The rotation band may be molded as one piece continuous with the shelf.

Each shelf may or may not be housed within a shelf frame, the shelf frame being structurally immobile with respect to the tower, and featuring an empty portion for receiving a shelf, the empty portion bordered on a top, bottom, and at least one side by a rigid portion. The shelf frames may bear the same geometric shape as the shelves.

Each shelf may comprise a tray receptacle, featuring at least a partial bottom wall and one or more side walls. The tray receptacle may be recessed in the shelf and configured to receive a makeup tray. A hole may be present in the bottom wall in order to provide for the easy removal of the tray. This hole may be in a centrally located portion of the tray receptacle or an edge, thereby permitting a user to press or lift the tray. Alternatively or additionally, a portion of a side wall may be cut-away so as to enable the tray to be slidably removed from the shelf or otherwise grasped and removed.

A tray may mount a shelf by a tight-fit interlock. A portion of the tray and a portion of the shelf may be inversely shaped on the same plane or planes, so that the one snaps into place with respect to the other. A tray may be magnetically coupled to a shelf, so that a threshold force is required to remove a tray from its shelf. In this embodiment, the tray has one or more magnets and the shelf has one or more magnets, and these two sets of magnets may be placed adjacent to each other, though embedded in the separate components of tray and shelf.

Each shelf may feature a shelf knob that facilitates rotation by providing a surface area at least partially at an angle or extending from the surface of an outer wall of the shelf. Alternatively, the exterior of the shelves are smooth and streamlined.

The shelf frames may feature knobs or extensions that prevent rotation of the shelves at selected degrees of rotation. These stop knobs may be arranged in a staggered formation down the vertical of the tower so that when all shelves are rotated to their max degrees, based on the arrangement of the stop knobs, overlapment of the shelves is limited. In one variation, the stop knobs extend from the second tower. These knobs may extend out of an exterior portion or disposed at or within a peripheral portion without extending outward.

The shelves and shelf frames may each provide a portion of an outer wall. The portion of the outer wall attached to the shelf may contact the portion of the outer wall attached to the shelf frame, thereby providing a seal or complete covering for the interior. The contact of the portions of the outer wall during rotation may impede the shelf from being rotated too far into the sealed position.

The shelves and shelf frames may be magnetically engaged, so that a threshold force is needed to rotate the shelves out of and away from the shelf frames. Also, when the shelves are rotated toward the sealed position, the shelves will snap into place by virtue of the magnets proximating. One or more magnets may be embedded in each shelf, and one or more magnets may be embedded in each shelf frame or portion thereof.

The second tower may feature a cap that may be moved to provide access to the brush receptacle. The cap may be connected to an elevator platform by means of a cord or hard rigid attachment rod. As the cap is raised, the elevator platform is also raised, thereby providing better access to the brushes. The cap may or may not feature a handle or knob to facilitate usage. The elevator platform may comprise at least a partial bottom wall and one or more partial side walls. The elevator side walls may be flush with the interior of the side walls of the second tower. Lubricant may be placed at a portion of the space in between the elevator side walls and the second tower side walls to smooth movement. The elevator may also lack side walls entirely, in which case the bottom wall may feature a rubber, felt, or other friction-modifying material, which may be glued or tightly wound around the periphery of the bottom wall. The elevator platform may be translationally impeded via one or more beads or rings disposed on the interior of the second tower and/or the elevator platform.

In one embodiment, a spring may be disposed at the bottom of the second tower so that, though the cap, via the rod, can press the elevator platform down against the spring, forcing the spring into a tense, coiled state, the removal of the cap will cause a dispensing of the force in the spring, thus ejecting at least partially the elevator platform above the second tower. The cap may be threadably engaged with threading interior to the second tower so that its removal requires a user to rotate the cap against the second tower. Alternatively, the elevator platform is threadably engaged to a lower portion of the second tower.

In one variation, the elevator platform is temporarily fixed against the spring via a twist-and-lock rotation lock. In this variation, the cap is not removed, but merely rotated by the user. In this variation, the spring communicates force through the elevator platform and the rod, and thereby, to the cap, which is ejected with the elevator platform and the rod as once piece. In a version of this variation, the twist-and-lock rotation lock is disposed at a top portion of the second tower, and engages the second tower to the cap.

In another embodiment, a first magnet is disposed in or on the elevator platform, a second magnet is disposed on the bottom wall or a bottom portion of the second tower, and the first and second magnets are engaged so that a threshold force is required to separate them. In an alternative embodiment, the first and second magnets are repulsively engaged so that the second magnet repels the first magnet, thereby ejecting the elevator platform at least partially from the second tower. In this embodiment, the elevator platform may be nonetheless locked to the second tower via threading, snap-fit, or twist-and-lock rotation lock. In another embodiment, a lever may be disposed on or adjacent to the top or bottom of the second tower. The lever may be spring-loaded, so that a threshold force must be overcome in order to depress the lever. The lever may lock the elevator platform into place in its default setting, so that be depressing it, the angle of the lever changes and the elevator platform is freed from the lever impediment.

The tower may feature a base portion disposed beneath and attached to the series of shelves and/or shelf frames. The base portion may be shaped substantially like a cross section of the tower, although it may also be wider so as to increase stability. Pads or scratch-mitigating material may be placed or attached to the bottom of the base portion to provide for smoother movement of the tower across a table or resting surface. The base portion may be beveled, tiered, or similarly ornamented.

DETAILED DESCRIPTION

Figure 1B:
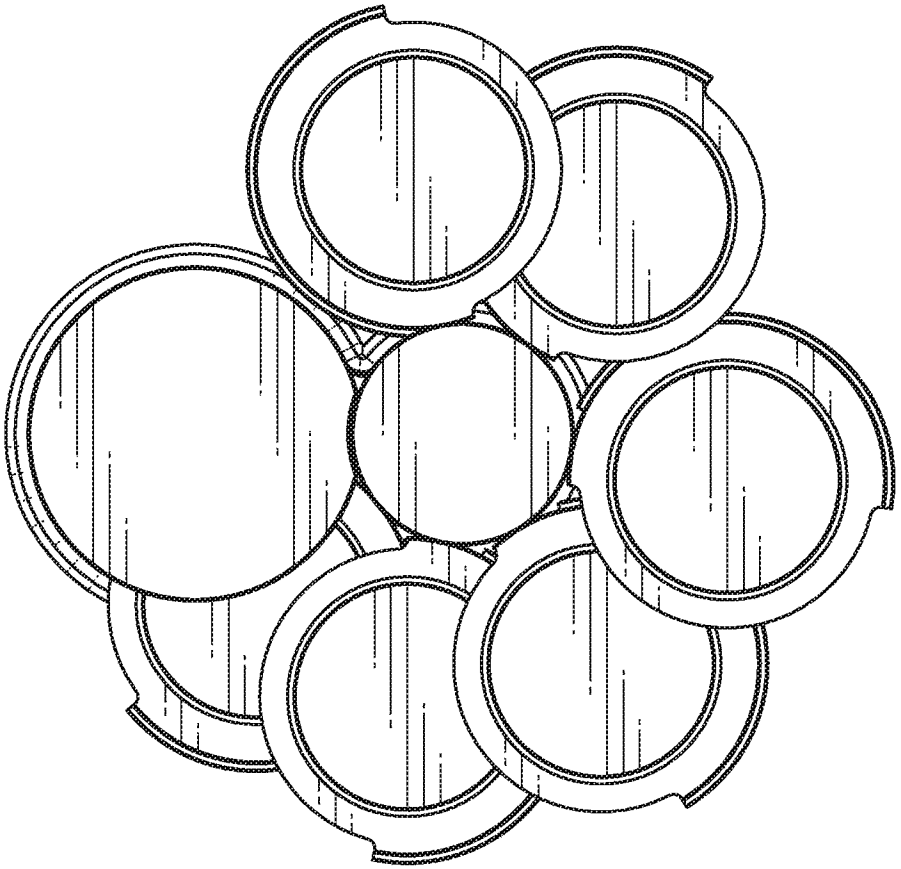
FIG. 1*b* shows a top view of the apparatus in an open configuration.
Figure 1A:
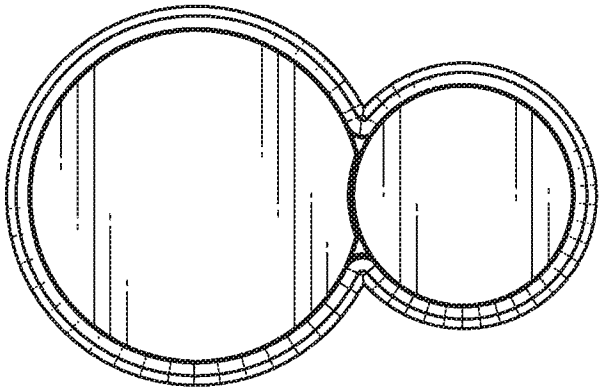
FIG. 1*a* shows a top view of the apparatus in a closed configuration.
Figure 2B:
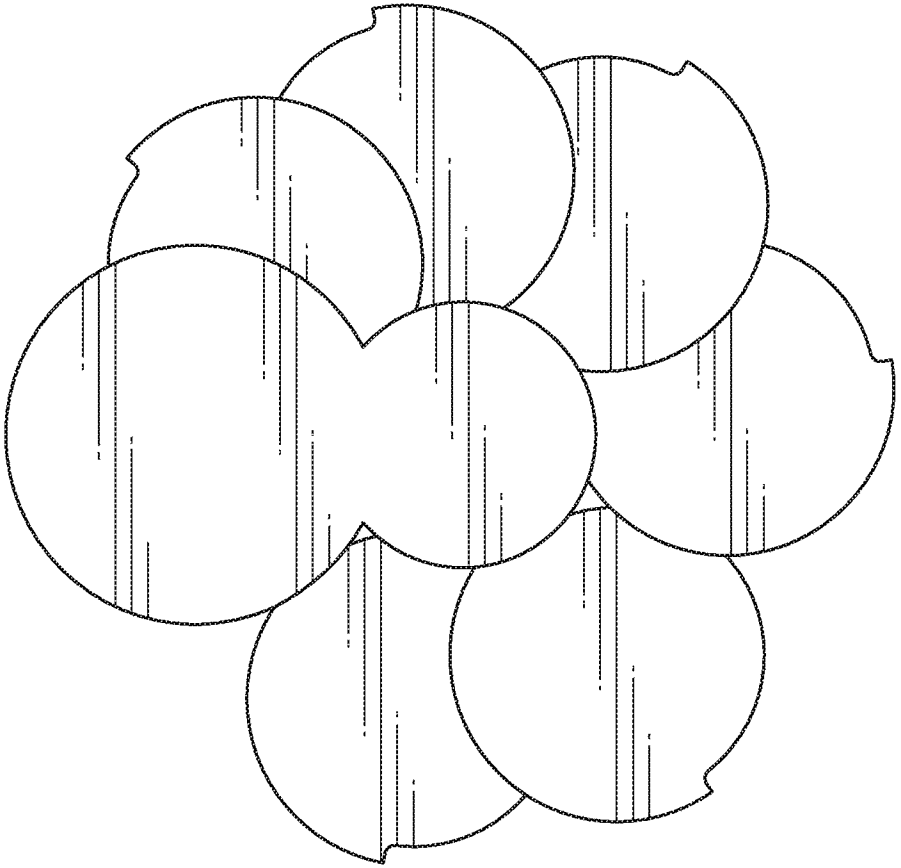
FIG. 2*b* shows a bottom view of the apparatus in an open configuration.
Figure 2A:
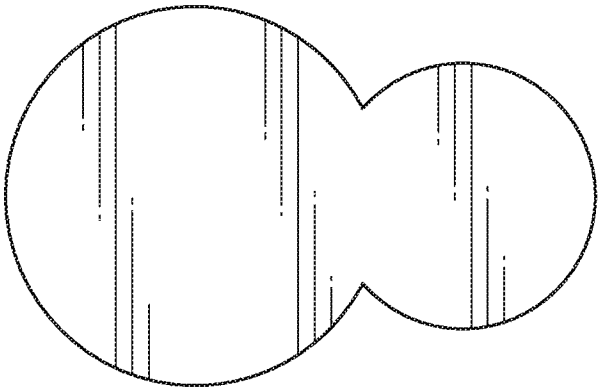
FIG. 2*a* shows a bottom view of the apparatus in a closed configuration.
Figure 3B:
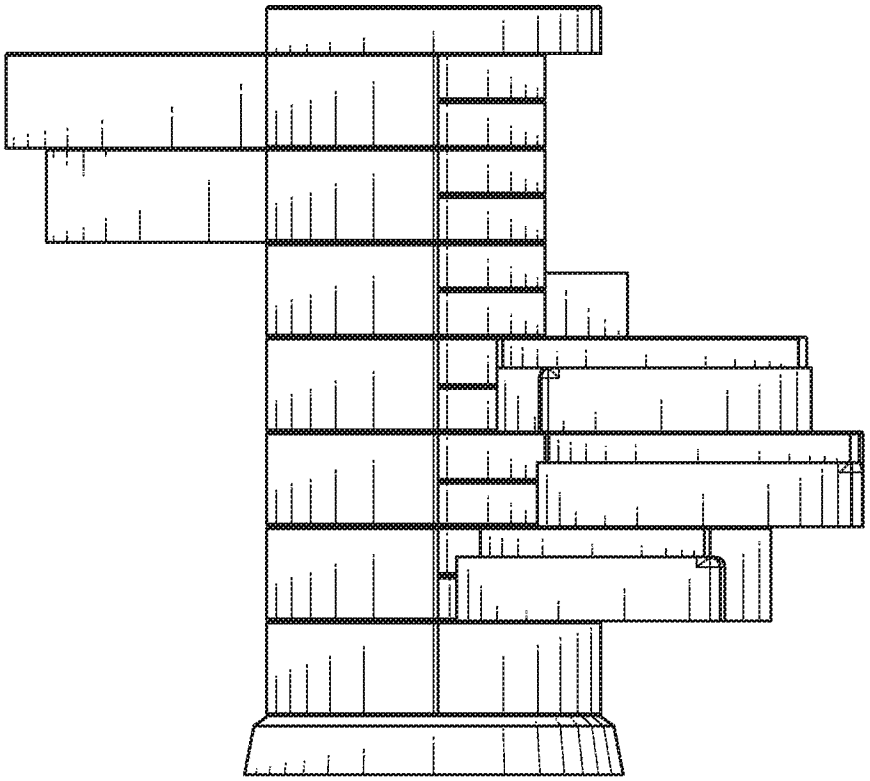
FIG. 3*b*, shows a first side view of the apparatus in an open configuration.
Figure 3A:
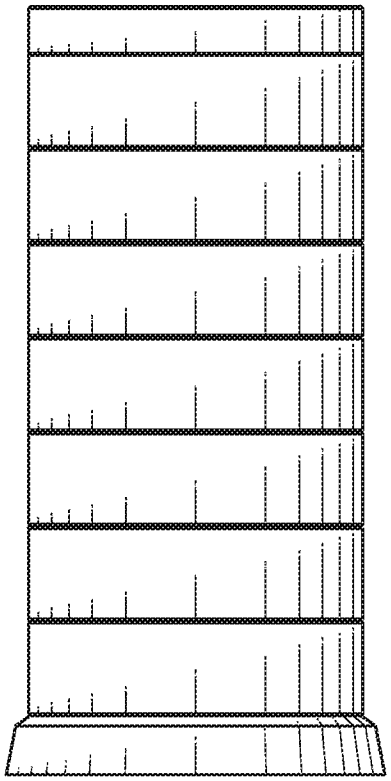
FIG. 3*a* shows a first side view of the apparatus in a closed configuration.
Figure 4B:
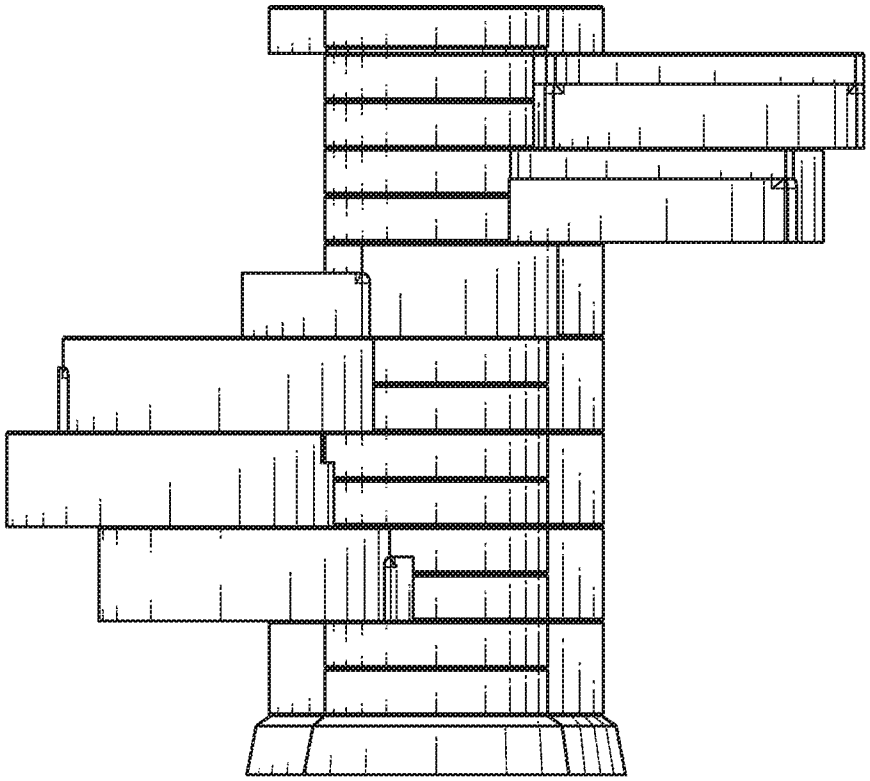
FIG. 4*b* shows a second side view of the apparatus in an open configuration.
Figure 4A:
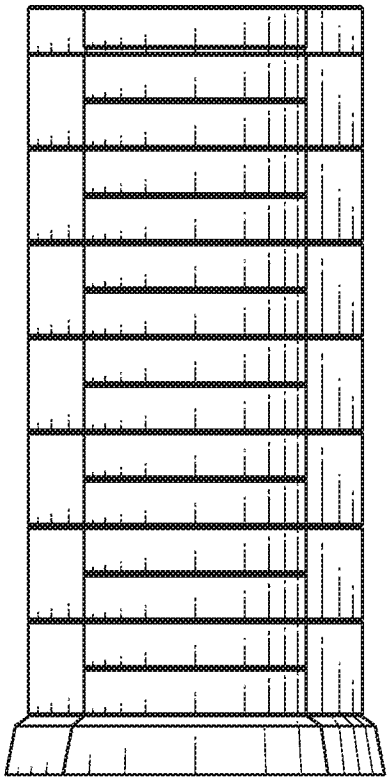
FIG. 4*a* shows a second side view of the apparatus in a closed configuration.
Figure 5B:
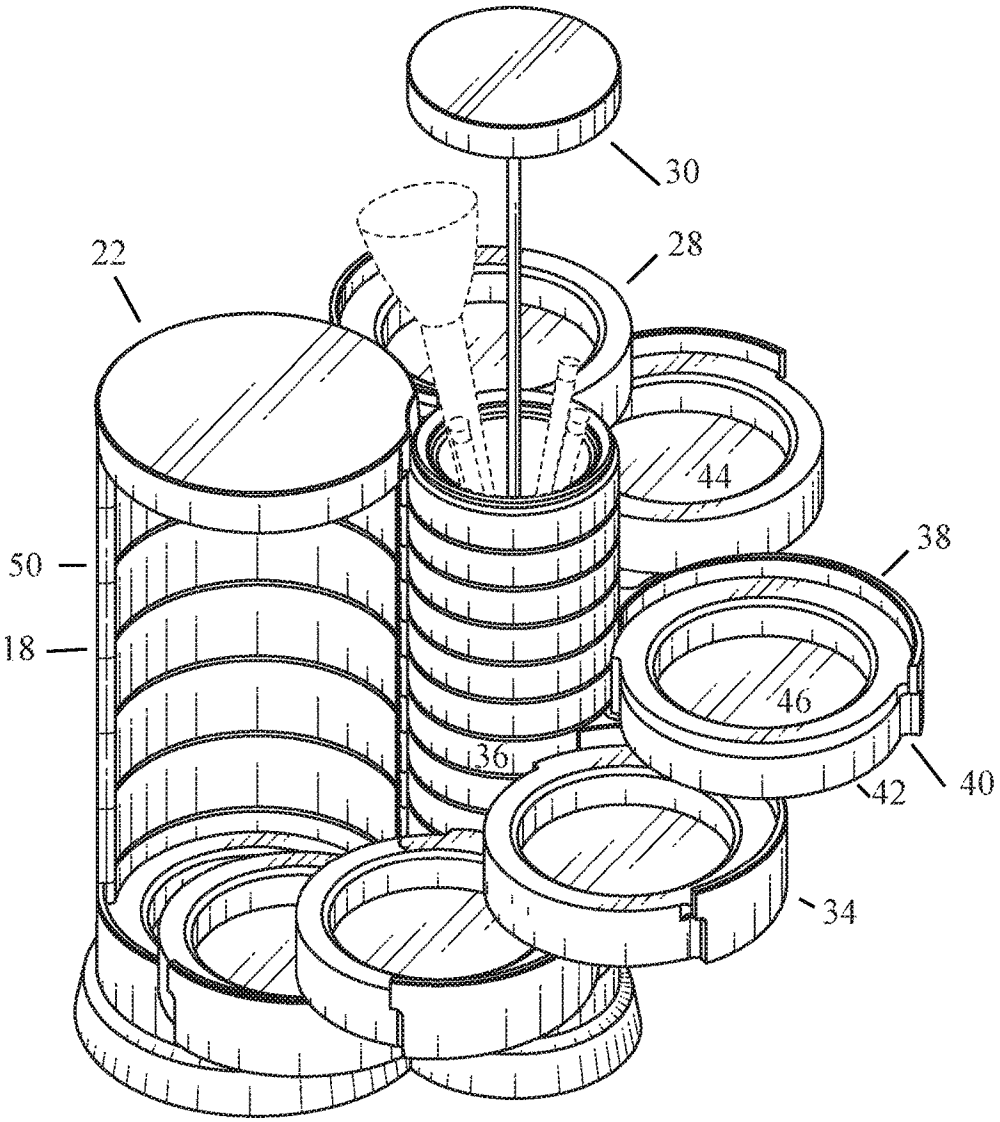
FIG. 5*b* shows a first side perspective view of the apparatus in an open configuration.
Figure 5A:
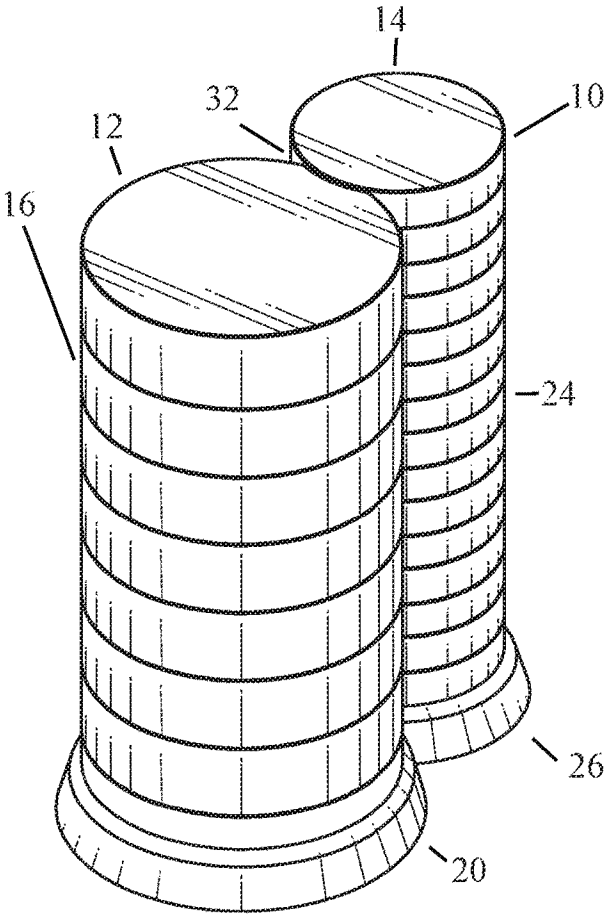
FIG. 5*a* shows a first side perspective view of the apparatus in a closed configuration.
Figure 6B:
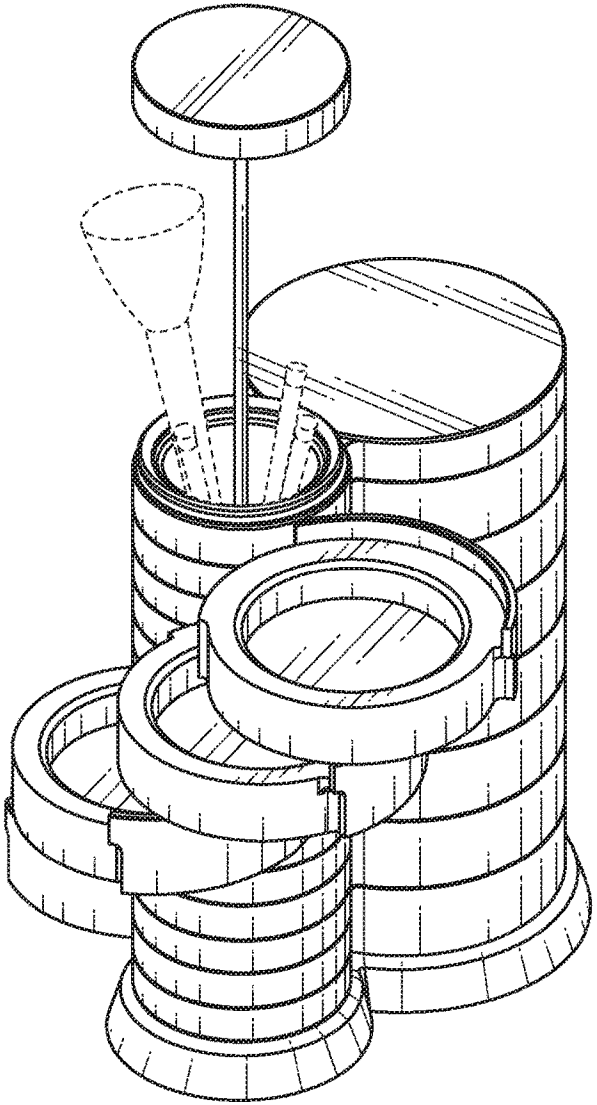
FIG. 6*b* shows a second side perspective view of the apparatus in an open configuration.
Figure 6A:
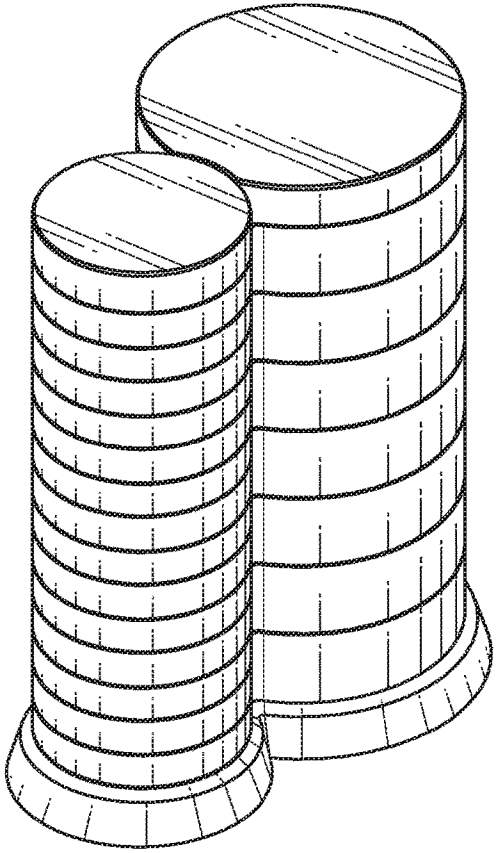
FIG. 6*a* shows a second side perspective view of the apparatus in a closed configuration.
Figure 7A:
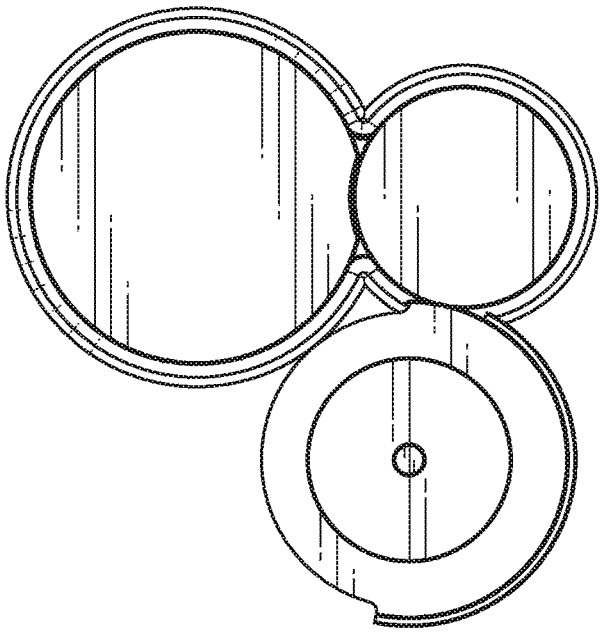
FIG. 7*a*-7*e* show diverse trays of the apparatus.
Figure 7B:
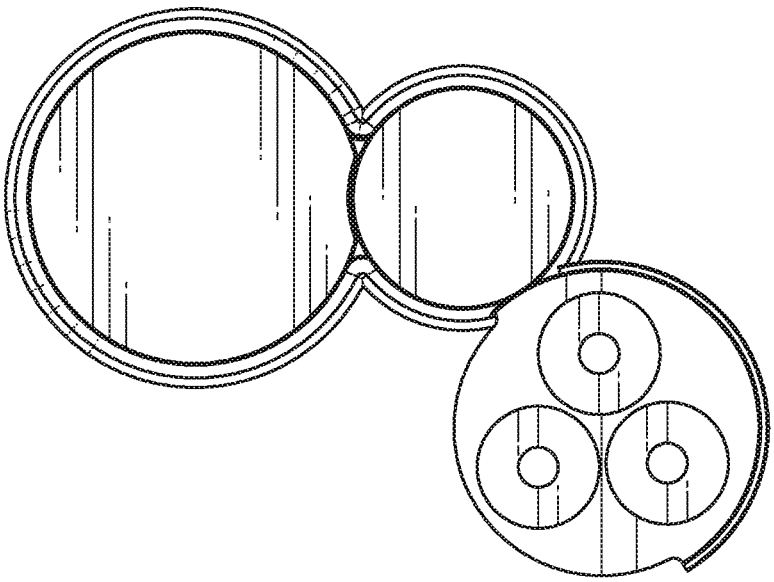
Figure 7C:
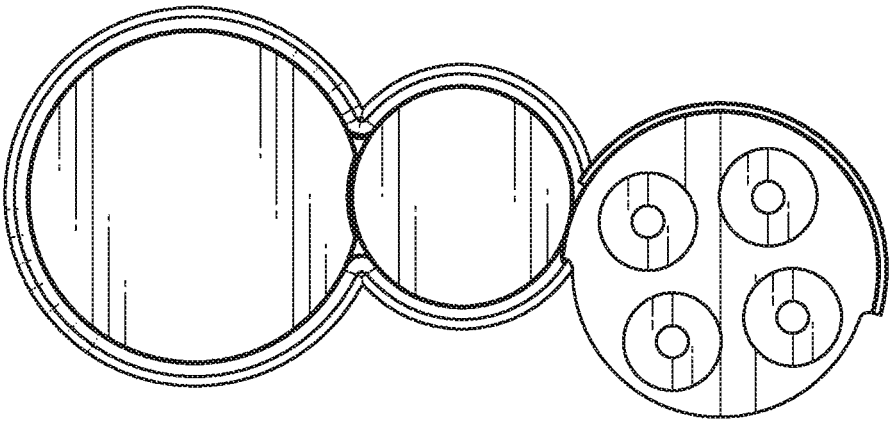
Figure 7D:
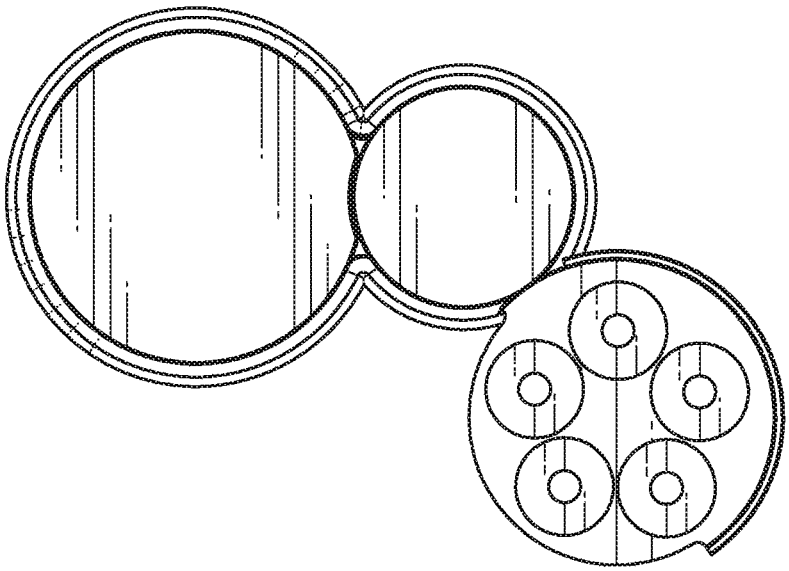
Figure 7E:
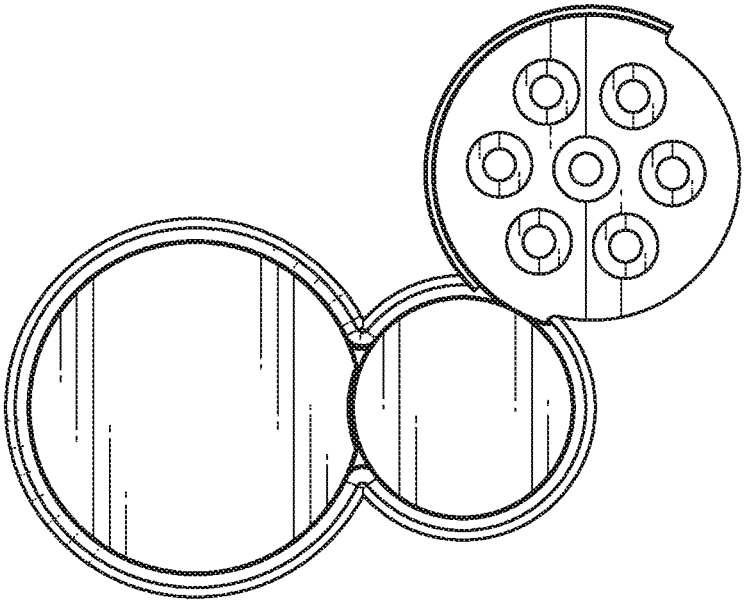

As shown in FIGS. 1A-6B, the storage apparatus 10 may comprise a first tower 12 and a second tower 14. The first tower may comprise a set of shelves 16, a side wall 18, a bottom wall 20, and a top wall 22. The second tower may comprise a side wall 24, a bottom wall 26, a cavity 28, and a top 30. The first and second towers may be connected at a circumferential point 32.

Each shelf may comprise a first ring 34 and a second ring 36. The second ring may comprise an exterior wall 38, a lateral side 40, an interior wall 42, and a tray receptacle 44. The tray receptacle may comprise a bottom wall 46 and a makeup tray, which is placed on the bottom wall of the tray receptacle. The contour of the interior wall is shaped so that it will be flush against the inner side 50 of the side wall of the first tower. The bottom wall may feature an opening (not shown). Alternatively or additionally, the interior wall may feature an opening (not shown). The bottom wall opening may be a cut out that allows a user to touch the makeup tray with a finger and push the makeup tray out of the tray receptacle. Similarly, the interior wall opening may be a cut out that allows the user to touch and grab the makeup tray through the interior wall and slide or lift the makeup tray out of the tray receptacle.

FIGS. 7A-7E show an assortment of makeup trays, showing trays, with one, three, four, five, and seven sub-trays.

Figure 8A:
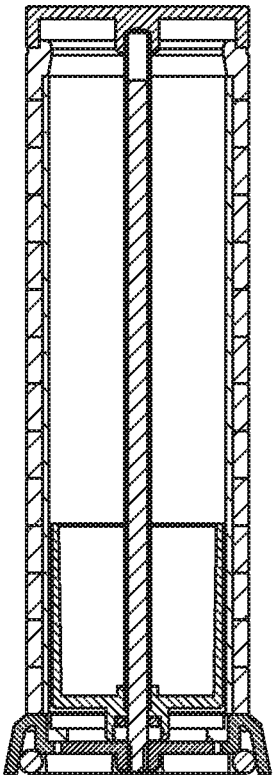
FIG. 8A shows a sectional view of the apparatus in a closed position.
Figure 8B:
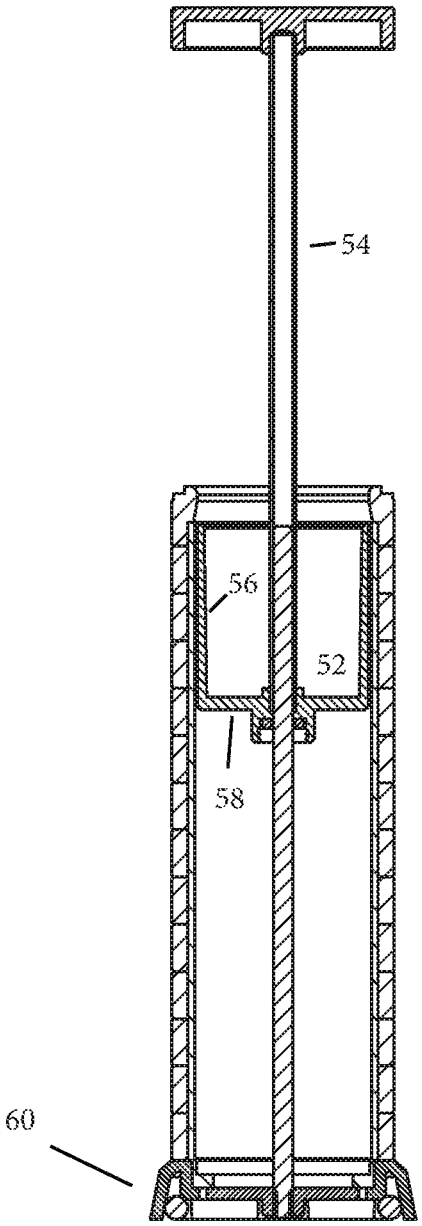
FIG. 8B shows a sectional view of the apparatus in an open position.

As shown in FIGS. 8A-8B, the second tower may also comprise an elevator platform 52, which may be attached to the top by a rod 54. The elevator platform may feature a bottom 56 and side walls 58. The bottom walls of the first tower and the second tower may attach to or be continuous with a base 60. In FIGS. 8A and 8*b*, the elevator platform is, respectively, at the bottom and middle or top of the cavity. The connection between the cap, the rod, and the elevator platform is demonstrated.

The invention claimed is:

1. A storage apparatus comprising a first tower and a second tower, the first tower comprising a set of shelves, each shelf comprising a storage tray and configured to rotate around the second tower;

the second tower comprising a storage cavity;

the second tower comprising an elevator platform configured to move in and out of the cavity of the second tower.

2. The storage apparatus in claim 1, each shelf configured to be independently rotatable around the second tower.

3. A storage apparatus comprising a first tower and a second tower, the first tower configured to store makeup and comprising a set of shelves, a side wall, a bottom wall, and a top wall;

the second tower configured to store cosmetic tools and comprising a side wall, a bottom wall, a cavity, and a top;

each shelf comprising a first ring and a second ring, each first ring being fitted to the second tower and configured to rotate around the side wall of the second tower, each second ring comprising an exterior wall, a lateral side, an interior wall, and a tray receptacle, the lateral side connecting the interior wall to the exterior wall, the tray receptacle disposed between the interior wall and the exterior wall and comprising a bottom wall configured to receive a makeup tray;

the interior wall of each shelf being shaped to fit flush against an inner side of the side wall of the first tower and the lateral wall configured to align with a lateral side of the side wall of the first tower so that the exterior wall is substantially continuous with an outer side of the side wall of the first tower; and the cavity of the second tower being formed by the side wall and the bottom wall of the second tower and configured to receive cosmetic tools.

4. The storage apparatus of claim 3, the second tower comprising an elevator platform, the elevator platform being disposed in the cavity of the second tower, comprising a bottom wall and a rod, and configured to be moved by the user from a bottom portion to a middle portion of the second tower, the rod connecting the bottom wall to the top.

5. The storage apparatus of claim 4, the elevator platform being friction fitted to the second tower and configured to remain at a height within the second tower unless a force stronger than gravity is applied and directed toward the bottom wall of the second tower.

6. The storage apparatus of claim 3, the top being rotationally or magnetically coupled to the second tower, with the top configured to, when in a closed position, conceal the cavity and not conceal the exterior wall of any shelf in the set of shelves of the first tower.

7. The storage apparatus of claim 4, the second tower additionally comprising a spring, the spring disposed between the elevator platform and the bottom wall of the second tower.

8. The storage apparatus of claim 4, the second tower additionally comprising a first magnet, the first magnet disposed between the elevator platform and the bottom wall of the second tower and configured to engage with a second magnet disposed on either the elevator platform or the bottom wall of the second tower.

9. The storage apparatus of claim 3, the first tower and the second tower each being substantially cylindrical.

10. The storage apparatus of claim 9, the diameter of the second tower being between 20% and 100% the diameter of the first tower.

11. The storage apparatus of claim 9, the diameter of the second tower being between 50% and 75% the diameter of the first tower.

12. The storage apparatus of claim 3, the shape or length of each exterior wall or the side wall of the second tower being configured so that each second ring has a unique degree of maximum rotation around the second tower.

13. The storage apparatus of claim 9, the first tower and the second tower being attached at circumferential points.

14. The storage apparatus of claim 3, additionally comprising a base, the base being larger than the bottom wall of the first tower and the bottom wall of the second tower and configured to provide stability.

15. The storage apparatus of claim 3, the interior wall comprising an opening providing access to a removable makeup tray.

16. The storage apparatus of claim 3, the bottom wall of the tray receptacle comprising an opening, the opening providing access to a removable makeup tray.

17. The storage apparatus of claim 3, each shelf being magnetically coupled to the side wall of the first tower.

18. The storage apparatus of claim 3, the tray receptacle being magnetically coupled to a removable makeup tray.

* * * * *